US005669370A

United States Patent [19]

Breedlove

[11] Patent Number: 5,669,370

[45] Date of Patent: Sep. 23, 1997

[54] TELESCOPIC STABILIZER

[76] Inventor: Charles E. Breedlove, 1708 S. Fairview Rd., Columbia, Mo. 65203

[21] Appl. No.: 606,083

[22] Filed: Feb. 23, 1996

[51] Int. Cl.[6] ..... F41B 5/20

[52] U.S. Cl. ..... 124/89

[58] Field of Search ..... 124/86, 88, 89; 403/109, 202, 203

[56] References Cited

U.S. PATENT DOCUMENTS

| | | | |
|---|---|---|---|
| 1,221,723 | 4/1917 | Guichard | 403/109 X |
| 3,589,350 | 6/1971 | Hoyt et al. | 124/89 X |
| 4,245,612 | 1/1981 | Finlay | 124/89 |
| 4,329,076 | 5/1982 | Coreth | 403/109 |
| 4,615,327 | 10/1986 | Saunders | 124/89 |
| 4,779,602 | 10/1988 | Hess | 124/89 |
| 4,893,606 | 1/1990 | Sisko | 124/89 |
| 4,936,283 | 6/1990 | Izuta | 124/89 |
| 5,090,396 | 2/1992 | Bickel et al. | 124/89 |
| 5,273,022 | 12/1993 | Leven | 124/89 |
| 5,320,085 | 6/1994 | Hanneman | 124/89 |
| 5,351,867 | 10/1994 | Vest | 124/89 X |
| 5,390,656 | 2/1995 | Villa et al. | 124/89 |
| 5,460,156 | 10/1995 | Sappington | 124/89 |
| 5,487,375 | 1/1996 | McDonald | 124/89 |
| 5,509,400 | 4/1996 | Chalin | 124/86 |

*Primary Examiner*—John A. Ricci
*Attorney, Agent, or Firm*—Richard J. Grundstrom

[57] ABSTRACT

An improved telescopic stabilizer basically having a plurality of telescopic tubes, one sliding over another. A centering device maintains center alignment of the tubes when the tubes are locked in a telescopic position. Threaded bores are provided at the outer ends of the tubes for attachment of the improved telescopic stabilizer to an archery bow and for the attachment of weights, additional stabilizer, or for use as a bow prop device. Plugs with threaded bores are typically used on inner ends for attachment of a locking member. The locking member is eccentrically and rotably attached to the plug. A bolt extends through the off center bore through the locking member. The bolt is screwed and tightened into an eccentrically located threaded bore on the plug. The locking member in the preferred embodiment has an internal interlock that locks the locking member to the bolt. This helps prevent the tubes from loosening during repeated shooting of the bow. The locking member locks the inner tube within the outer tube when the tubes are rotated about one another. A docking member is also included. The docking member is attached to an outer end of one of the inner tubes. When the improved telescopic stabilizer is in a closed or collapsed position, the docking device receives the end of the outer tube. This arrangement secures the end and provides an aesthetical appearance. The improved telescopic stabilizer is in the preferred embodiment made with three telescopic tubes. More or less tubes can be added. In one embodiment a three tube stabilizer can be easily converted to a two tube telescopic stabilizer.

22 Claims, 12 Drawing Sheets

62
64
22
30
66
20
58
24
56
32
50

50
30
16
34
20
58
32
56
24
18

50
30
22
62
20
16
56
18
14
30
58
56
18
24
12
34
32
36
50

TELESCOPIC STABILIZER

BACKGROUND OF THE INVENTION

The present invention relates to an improved telescopic stabilizer and more particularly to improvements made in telescopic tubes that function as a stabilizer.

There are many types of stabilizers known in the field of archery. The stabilizer typically attaches to the bow riser on a compound bow. Usually the bow risers are provided with a threaded bore for attachment of stabilizers or other equipment. The purpose of the stabilizer is to dampen vibration and absorb shock when an arrow is shot. Without the stabilizer, vibrations through the bow may be transmitted to the arrow as the arrow passes across an arrow rest. Bow shock can also be transmitted to the arrow. Both vibrations and shock may affect the flight of the arrow. In addition, both vibrations and shock are occurring in the outstretched arm of the archer. This causes archer fatigue.

Stabilizers come in many sizes, shapes, configurations and weight. There is a previously known telescopic stabilizer described in U.S. Pat. No. 3,589,350. The vibrations and shock of repeated shooting of arrows caused the tubes to loosen and separate. When the tubes are locked in a telescopic position, the larger tube is eccentrically positioned over the inner tube. This causes distractions to the archer as he shoots and is not aesthetical pleasing. When used during hunting, the vibration and shock also caused the tubes to vibrate against each other. Additional and unwanted noises were created by the vibration and shock of the tubes. The present invention overcomes these problems.

Accordingly, it is an object of the present invention to provide an improved telescopic stabilizer adapted to be securely locked in a telescopic position. With the improved telescopic stabilizer of this invention it has been found that the telescopic tubes do not loosen and separate, even after many more consecutive shootings than typical.

Another object of the present invention is to provide an improved telescopic stabilizer constructed to eliminate tube vibrations that cause unwanted and unnecessary noises.

A further object of the present invention is to provide an improved telescopic stabilizer adapted for center alignment of tubes within tubes when locked in a telescopic position to thereby substantially improve the aesthetical appearance and eliminate the distraction to the archer.

Still another object of the present invention is to provide an improved telescopic stabilizer that includes a docking device that docks and help secure the end of the telescoping tubes when in the collapsed position.

Still a further object of the present invention is to provide an improved telescopic stabilizer used as any basic stabilizer to absorb shock and dampen vibrations.

Another object of the present invention is to provide an improved telescopic stabilizer constructed of rigid material such that the stabilizer may also be used as a bow prop.

SUMMARY OF THE INVENTION

To accomplish the foregoing and other objects of this invention there is provided an improved telescopic stabilizer and more particularly to a telescopic stabilizer with improved locking device, new centering device and new docking device.

The improved telescopic stabilizer of this invention includes a plurality of telescoping tube that function as a stabilizer. The invention includes an improved locking device and improved centering devices. The tubes are lockable at any location along the intersecting length. The locking device has been improved by having increasing the number of O-rings on the cylinder member eccentrically attached to the end of the inside tube. As the tubes are twisted, the eccentrically attached cylindrical member binds the tubes to lock them in place. An internal interlock is also included which binds the locking member to the bolt.

The centering devices along the inner tube body maintains the tubes in perfect centered alignment when locked at any telescopic position. The centering device maintains the inner tube perfectly centered within the outer tube. The centering device in the preferred embodiment is a plurality of O-rings at essential locations. The number of centering devices would be determined by the length of the tubes.

The docking device is located at the end of an inner tubes. The docking device receives the end of the larger outer tube. This allows the telescoping tubes to appear more finished and to secure and hold the ends when the tubes are in the closed position.

This improved telescopic stabilizer includes a plurality of telescopic tubes. Two, three and even four tubes can by used. This allows the telescopic stabilizer to be of shorter length when in the collapsed or closed position.

These and other objects and features of the present invention will be better understood and appreciated from the following detailed description of the main embodiment thereof, selected for purposes of illustration and shown in the accompanying drawings.

DETAILED DESCRIPTION

Figures 1, 2, 3:
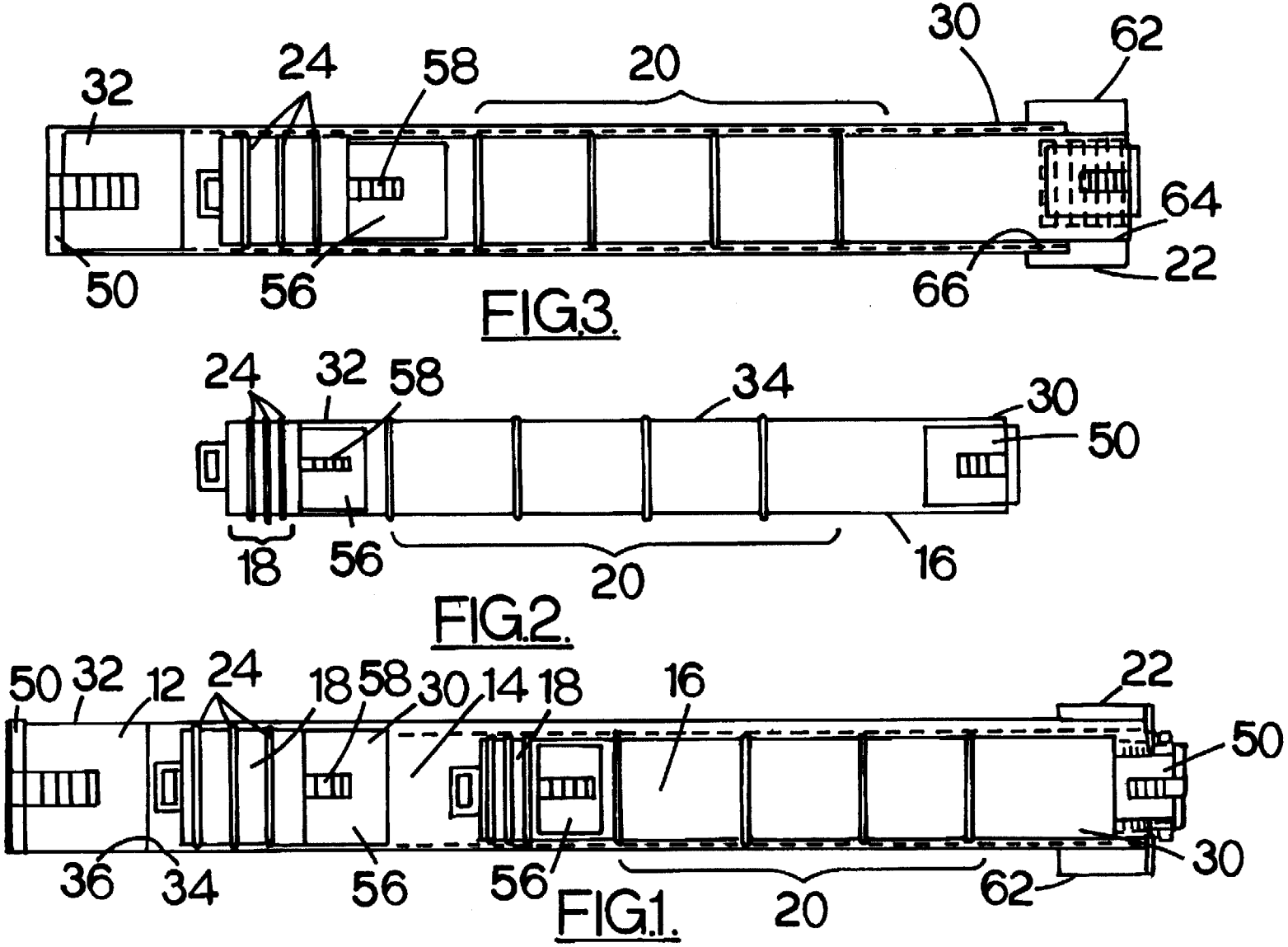
FIG. 1 is a side sectional view of an improved telescopic stabilizer of this invention having three tubes.
FIG. 2 is a side sectional view of a typical inner tube of the improved telescopic stabilizer.
FIG. 3 is a side view of a two tube telescopic stabilizer.

Referring now to the drawings in general there is shown the preferred embodiments of the improved telescopic stabilizer 10 of this invention.

The improved telescopic stabilizer 10 of this invention has several improvements and features not previously available on telescopic stabilizers. The improved telescopic stabilizer 10 has, a plurality of telescopic tubes. Each of the inner tubes slides within an outer tube. Generally, the tubes can be referred to as an outer tube or as an inner tube depending on the orientation of the tube. As the names suggest, the inner tube will always be within an outer tube. The outer most tube is referenced as 12, the inner tube that is also a middle tube is references as 14 and the inner most inner tube is 16.

In one embodiment or another, the improved telescopic stabilizer will include an increased number of telescopic tubes, an improved locking member 18, a centering means 20, and a docking device 22.

A locking member eccentrically attached to the end of the inside tube is known in the art. As the tubes are twisted, the eccentrically attached cylindrical member binds the tubes to lock them in place. The improvement of this invention is an increased number of O-rings 24 placed on the locking member 18. The increased number of O-rings 24 provides additional friction to ensure locking. Prior art only had one O-ring. Another improvement is an internal interlock 26. The internal interlock 26 binds the locking member 18 to the bolt 28 that attaches the locking member to a first end 30 on the inner tubes 14 and 16.

Another improvement includes the centering means 20 along the body or length of the inner tubes 14 and 16. The centering means maintains the tubes 12, 14, and 16 in perfect centered alignment when locked at any telescopic position. The prior art would offset the tubes so that the inner tube would be offset within the outer tube. The inner tube would rest against one inside tangent on the inner surface of the outer tube. This would leave a larger opening along the opposite side of the tube. The centering device 20 maintains the inner tube 16 perfectly centered within the middle tube 14 and the middle tube 14 centered within outer tube 12.

The next improvement is a docking device 22. The docking device 22 is located at the end of one of the inner tubes 14 or 16. The docking device 22 is a sleeve type device that butts against or receives the second end 32 of an outer tube 12. The docking device 22 allows the telescoping tubes to appear more finished and to better hold and secure the end of the outer tubes when the tubes are in the closed position.

Another improvement is the telescoping tubes consisting of three telescoping tubes rather than two. This allows the improved telescopic stabilizer 10 to be of shorter length when in the collapsed or closed position. This feature allows the improved telescopic stabilizer 10 to be used in competition where there are length limits on the accessories on the bow.

The preferred embodiment and the best mode contemplated of the improved telescopic stabilizer 10 of the present invention are herein described. However, it should be understood that the best mode for carrying out the invention hereinafter described is offered by way of illustration and not by the way of limitation. It is intended that the scope of the invention includes all modifications that incorporate its principal design features.

The improved telescopic stabilizer 10 has a plurality of elongated tubes 12, 14, and 16. In the embodiments as shown there are either two or three telescopic tubes. Four or more tubes could also be used if desired. However, strength, practicality and materials will dictate the number. The tubes generally slide one within the other. Each of the tubes 12, 14 and 16 will have a first end 30, a second end 32, an inner surface 34 having an inner diameter and an outer surface 36 having an outer diameter. The tubes' 12, 14 and 16 are arranged with an inner tube or tubes and an outer tube or tubes. One of the inner tubes will be an inner most tube 16 and one of the tubes will be an outer most tube 12.

Typically, the tubes 12, 14 and 15 are made from aluminum, but other materials known or unknown may be substituted. Aluminum has demonstrated strength and weight characteristics that are desirable. The size or thickness or the tubes 12, 14 and 16 may vary depending on the particular embodiment. Thin or thick wall aluminum tube may be used. In one three tube embodiment, the outer tube 12 has an outer diameter of 1 inch and an inner diameter of 0.880 inches. The middle tube 14 has an outer diameter of 0.870 and an inner diameter of 0.760 inches. The inner most tube 16 has an outer diameter of 0.750 inches. Diameters may vary depending on the model of telescopic stabilizer. The first end 30 on the tubes 12, 14, 16 may also be tapered for a more pleasing appearance.

Figure 15:
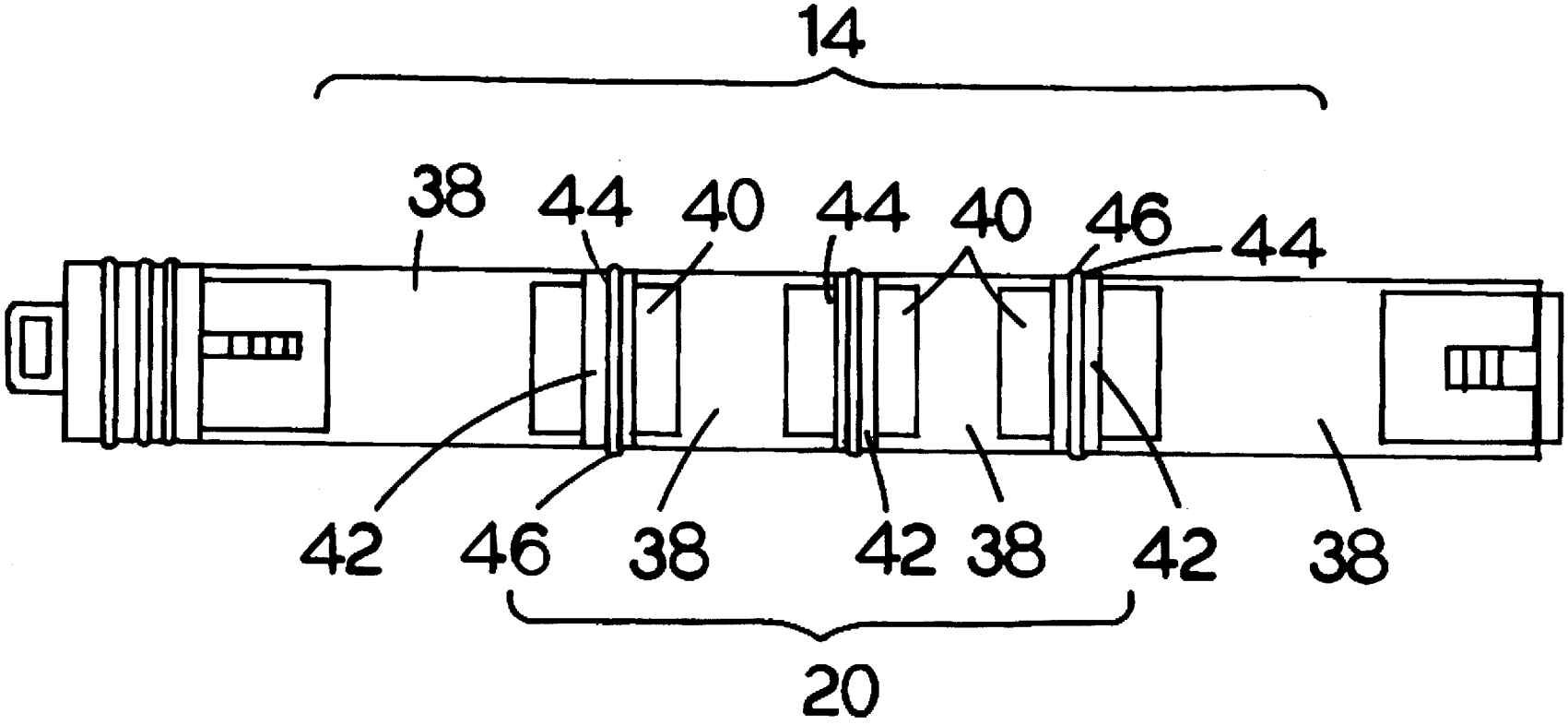
FIG. 15 is a side elevation view of an inner tube made with a plurality of tube sections and couplers.

In one embodiment, shown in FIG. 15, the inner tube 14 is made with a plurality of tube sections 38 joined with couplers 40. The tube sections 38 are made with a thin wall aluminum tube. The couplers 40 may be pressed into the ends of the tubes 38 or glued or a combination of both. A center outer surface area 42 of the couplers 40 may contain an O-ring groove 44. The O-ring groove 44 in conjunction with in O-ring 46 is used as a centering means 20. On thick wall tubes, the O-ring grooves 44 may be machined or made directly on the inner tubes 14 and 16.

Figure 8:
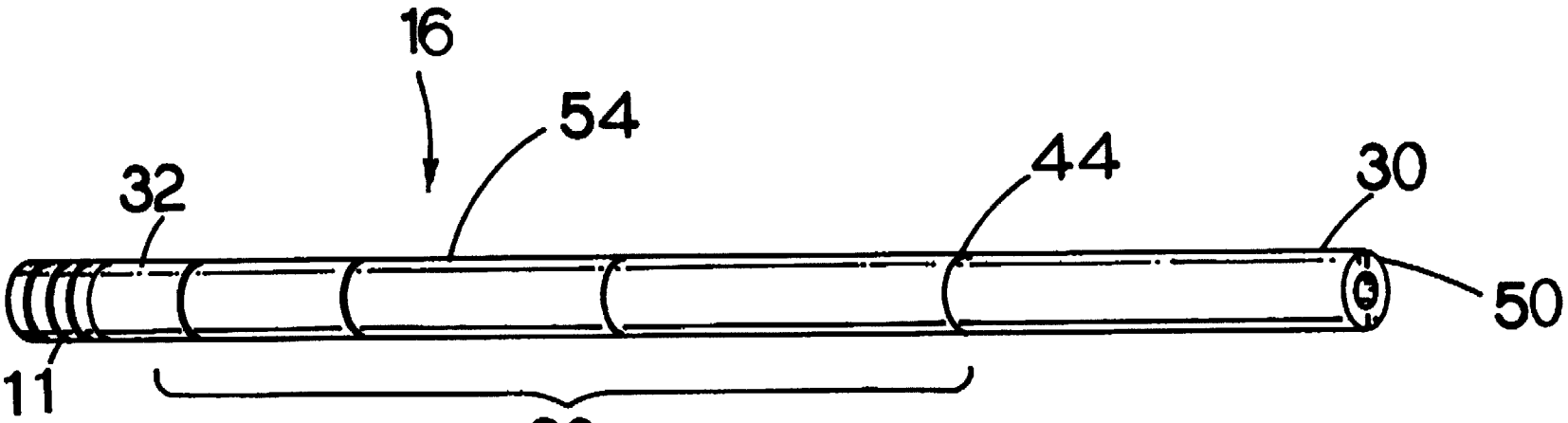
FIG. 8 is a solid rod that slides within a thin wall inner tube having a locking member and a centering device of O-rings along the length.
Figure 7:
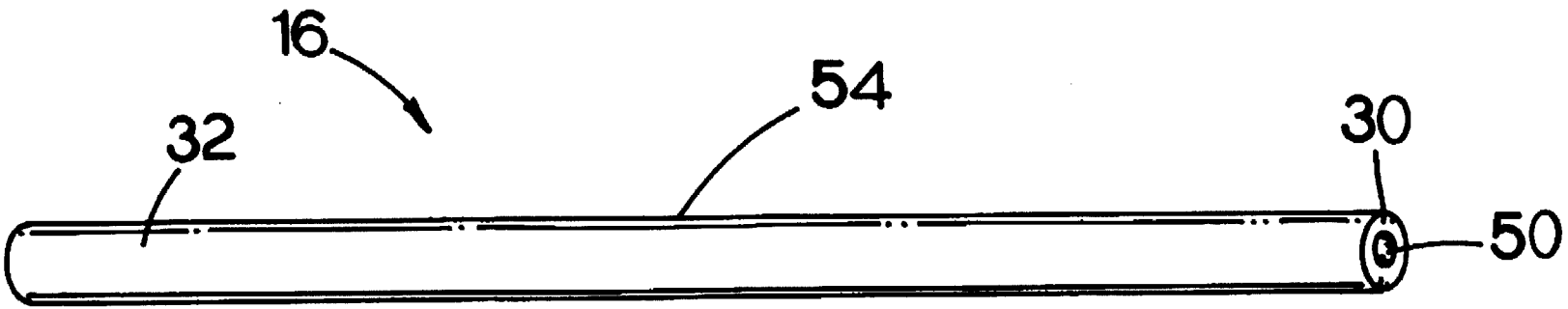
FIG. 7 is a solid rod that slides within the second opening of a tube as shown in FIG. 6 and is locked in place by an external bolt.

The inner most tube 16 may also be made as a solid rod 54 rather then a tube, as shown in FIGS. 7 and 8. There are two embodiments of solid rods 54 being used as an inner most tube 16. The first, FIG. 7, has a smooth outer surface. The other embodiment, has O-ring grooves 44 for receipt of O-rings 46 along the length of the Outer surface. The embodiment shown in FIG. 8 also uses a locking member 18, whereas the other does not.

The centering means 20 assist in maintaining center alignment of the inner tubes 14 and 16 within the outer tube 12 when the tubes are locked in a telescopic position. FIGS. 1, 2 and 3. The centering means 20 is located between the outer surface 34 of the inner tubes and the inner surface 36 of the outer tubes. The centering means 20, in the preferred embodiment, contains a plurality of O-ring grooves 44 along the outer surface 34 of the inner tubes 14 and 16. O-rings 46 are installed within the O-ring grooves 44 to close the space between the inner surface 36 of an outer tube and the outer surface 34 of an inner tube. The O-rings 46 are located at essential locations along the length. The number of O-rings 46 would be determined by the length of the tubes. The centering means 20 also reduces vibration within the tubes 12, 14 and 16.

Figure 4:
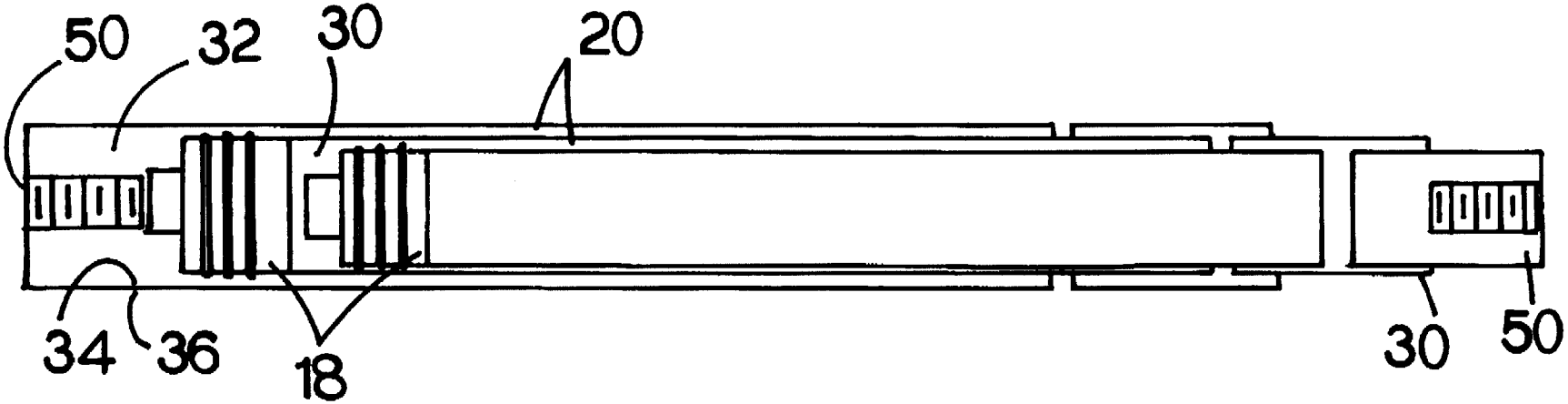
FIG. 4 is a side view of another embodiment of the improved telescopic stabilizer having three tubes.
Figure 5:
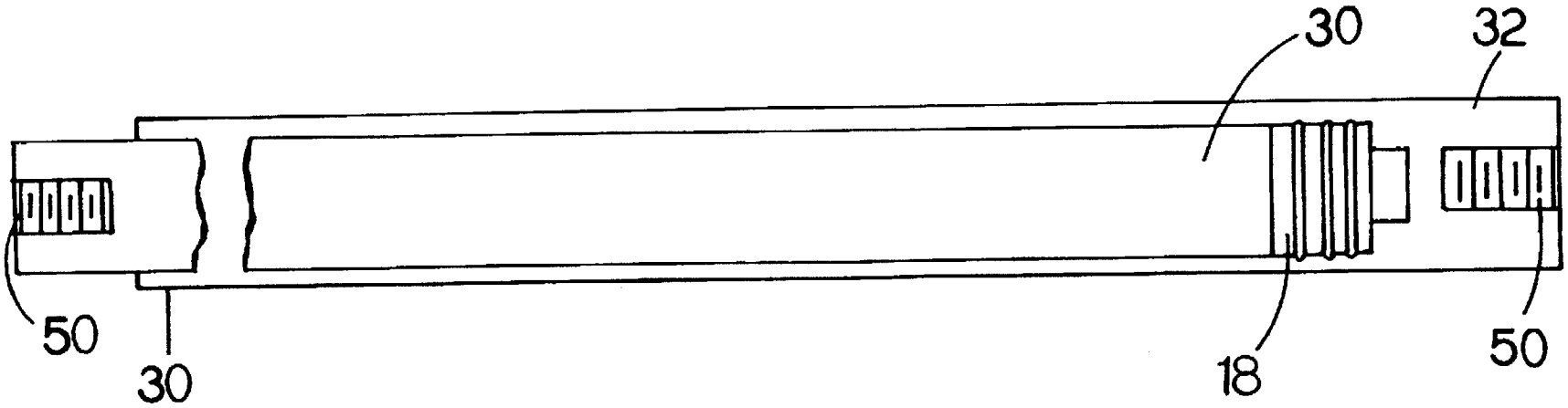
FIG. 5 is a side view of another embodiment having two tubes.
Figure 10:
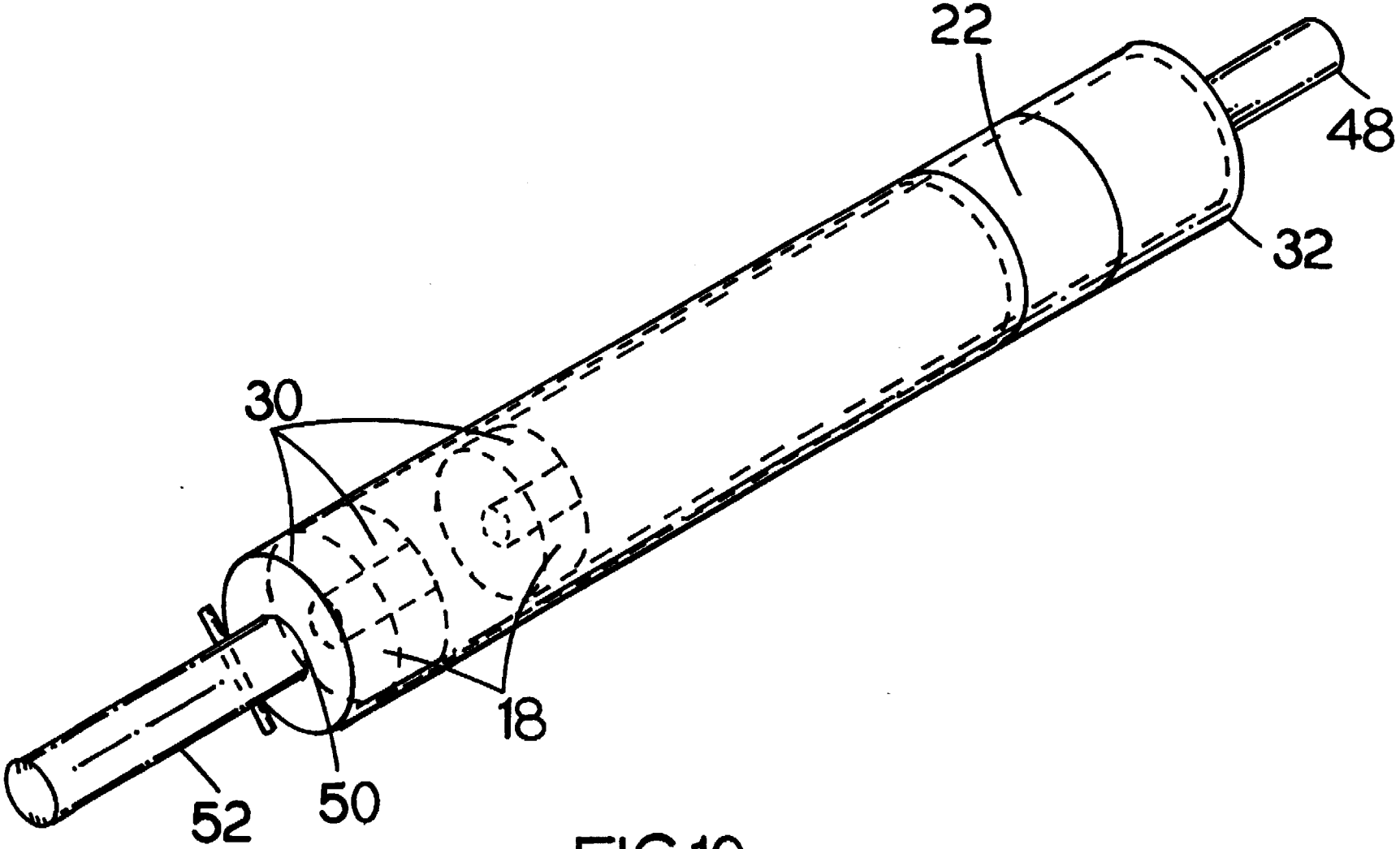
FIG. 10 shows yet another embodiment of a three tube telescopic stabilizer showing a docking device.

In another embodiment, FIGS. 4, 5, and 10, the centering means 18 consists of a very close tolerance between the inner diameter of the outer tube and the outer diameter of an inner tube. The tolerance maintained at approximately 0.008 inches or less has been found to be adequate to reduce vibration and assist in maintaining center alignment of the inner tubes within the outer tube. This close tolerance is not typical in prior art or with typical aluminum tubes available.

Figure 9:
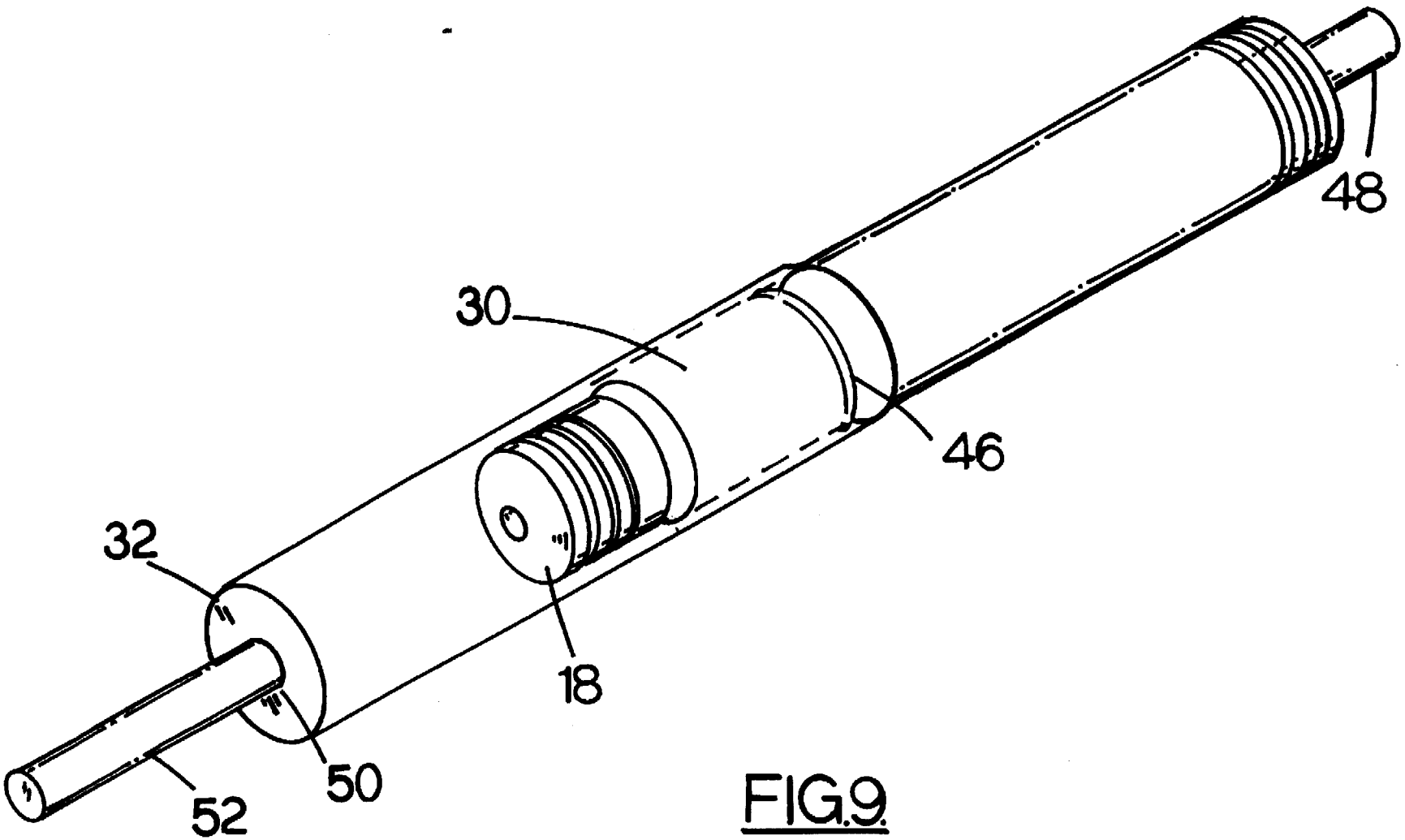
FIG. 9 is a two tube embodiment of the improved telescopic stabilizer showing O-rings as the centering device and showing an improved locking member.

A plurality of O-rings 46, FIG. 9, can also be installed on the outer surface 34 of the inner tubes. The O-rings 46 must be of proper diameter and thickness and must snugly fit the space between the inner surface 36 of the outer tube and the outer surface 34 of the inner tube. The O-rings reduce vibrations, as well as maintain center alignment of the inner tubes within the outer tube.

The telescopic stabilizer 10 is typically attached to a threaded bore on the bow riser using a short threaded rod 48. The threaded rod 48 attaches to an attachment means 50 on the first end 30 on the inner most tube 16. In the preferred embodiment, the attachment means 16 resembles a plug having a centered threaded bore. The attachment means 50 is pressed into the end and may be glued for additional securing. A similar attachment means 18 is located and installed on the second end 32 of the outer most tube 12. The attachment means 50 at the second end 30 is used for attachment of weights, additional stabilizer, or a bow prop device 52. The attachment means 50 on the solid rods shown in FIGS. 7 and 8 is a longitudinal threaded bore centered on the first end 30. The threaded bores used as an attachment means are threaded at a standard of 5/16 inch diameter and 24 threads per inch.

The preferred and recommended position of the improved telescopic stabilizer 10 is to have the first end 30 of the inner most tube 16 attached to the bow riser. This places the tube with the smallest diameter attached to the bow. At first this arrangement seems backwards. This arrangement actually provides the greatest strength at the outer end so the improved telescopic stabilizer can be used as a bow prop. A bow prop device 52 such as a spike like device is typically installed into the attachment means 18 on the second end of the outer most tube 12 tube. The spike can then be pushed into the ground to hold the bow or inserted into a reciever type device.

Plug 56 are installed within the second ends 32 on the inner tubes 14 and 16. The plugs 56 are cylindrical members typically with an outer flange at one end. The plugs 56 are pressed and may be glued within the second ends 32 of the tubes 14 and 16. The plugs 56 have an eccentrically located threaded bore 58 on the lateral face. The eccentrically located threaded bore 58 is used for the attachment of the locking member 18.

Figure 16:
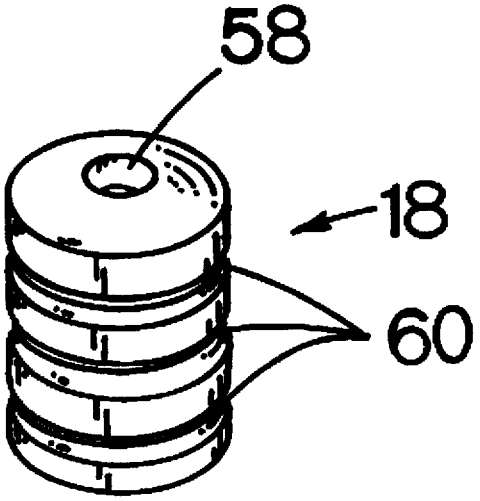
FIG. 16 is a view of a locking member showing O-ring groove and eccentrically located threaded bore.

The locking member 18 is an improved cylindrical locking member. The locking member 18 is eccentrically and rotatably attached to the plug 58, as in the prior art. The locking member 18 locks the inner tube within the outer tube when the tubes are rotated about one another. In the preferred embodiment, FIG. 16, the locking member 18 has a plurality of O-ring grooves 60 and an O-rings 24 in each of the grooves. The plurality of the O-rings 24 securely grips and locks the inner tube within the outer tube when the tubes are rotated about one another. Prior art only had a single O-ring that was not adequate.

Figure 11:
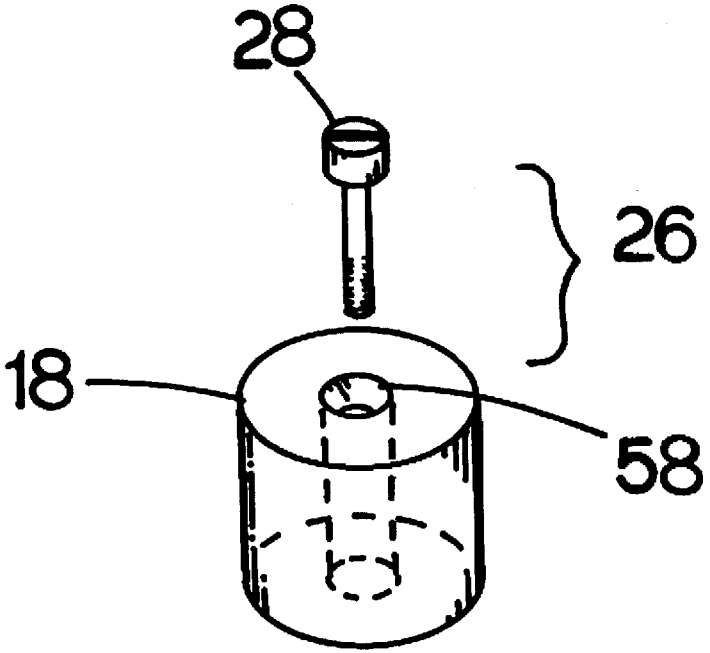
FIG. 11 is an isometric view of another locking member having an internal interlock.
Figures 12, 13, 14:
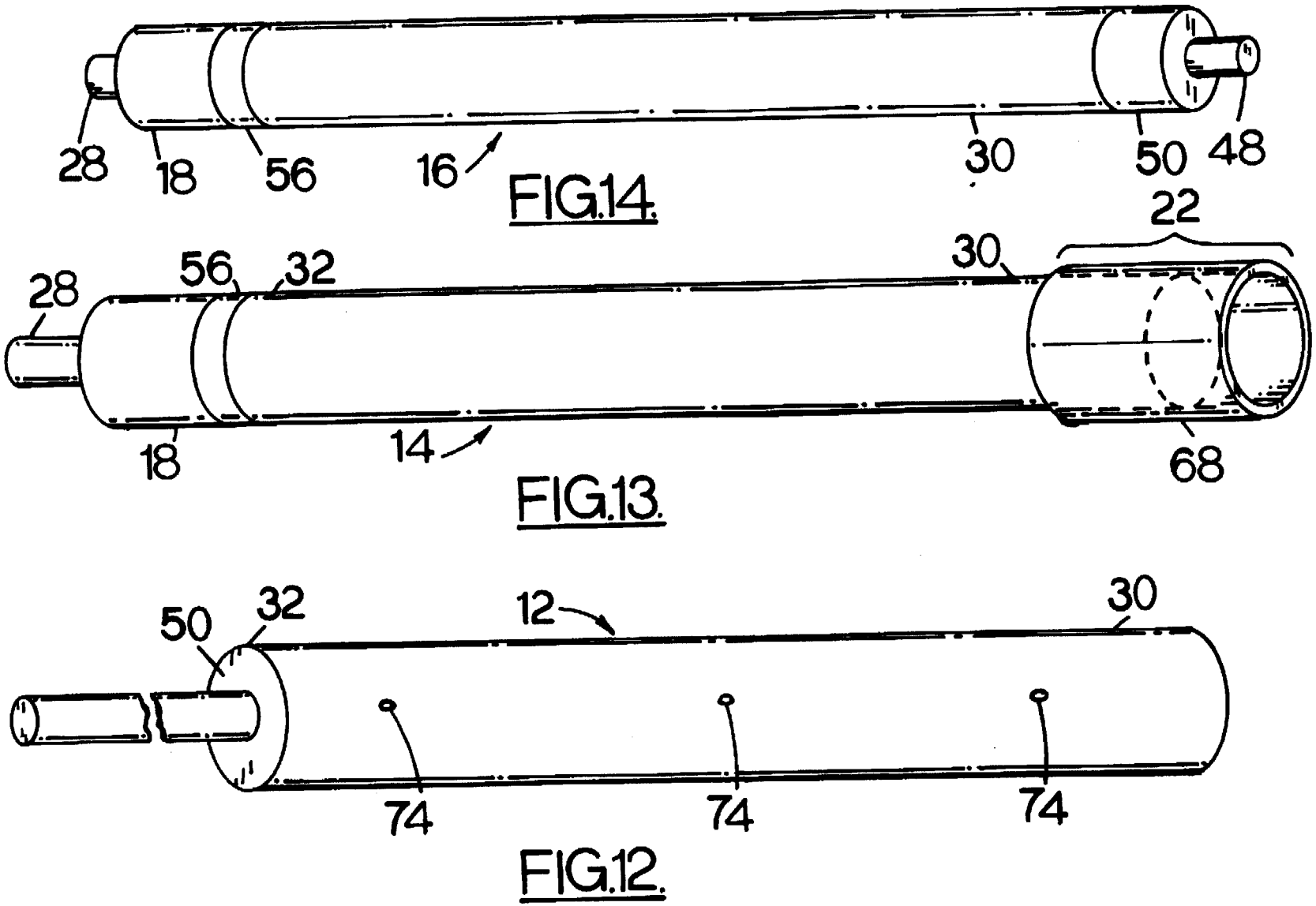
FIG. 12 is a view of an outer most tube shown in FIG. 10.
FIG. 13 is a view of an inner tube that is also a middle tube that fits within the tube shown on FIG. 12 having a docking device and a locking member.
FIG. 14 in an inner most tube that fits into the middle tube shown in FIG. 13 having a locking member.

Another embodiment FIG. 11, the locking member 18 is constructed from a nylon material that securely grips the inner surface 36 of an inner tube. The locking member 18, in this embodiment, is a short cylindrical nylon rod.

The locking member 18 may also include an internal interlock 26. The internal interlock 26 is made by an enlarged off center bore 58 eccentrically located longitudinally through the locking member 18 and a bolt 28 extending through the enlarge off center bore 58. The bolt 28 is used to attach the locking member 18 to the eccentrically located threaded bore 58 on the plug. The internal interlock 26 locks the locking member 18 onto the bolt 28 when the inner and outer tubes are rotated about each other. The off center bore 58 must be substantially larger than the diameter of the bolt 28 for the internal interlock 26 to work. In the preferred embodiment a ¼ (0.250) inch diameter bolt 28 is used and the diameter of the enlarged off center bore 58 is 0.328 inches. A smaller diameter bore does not allow the locking device 18 to lock onto the bolt 28. The off set from center is approximately 0.060 inches.

The docking device 22 is a sleeve like device. The docking device has two functions. It either receives or butts against the first end 30 of the outer tube 12 to help secure the tubes when in a closed position and provides an aesthetic appearance.

In the preferred embodiment, the docking device 22 is a sleeve 62 that receives and secures the first end 30 of the outer most tube 12. The docking device 22 or sleeve 62 has a first inner diameter 64 that securely attaches the sleeve 62 to the outer surface 34 on the first end 30 of an inner tube. A second inner diameter 66 receives and holds the first end 30 of the outer most tube 12 when the improved telescopic stabilizer is in a collapsed or closed position. The first end 30 of the outer most tube fits securely within the second diameter 66. This securely holds the ends of the tubes and provides an aesthetical appearance.

In another embodiment, the docking device 22 is a sleeve 68 having a single inner diameter. The inner surface of the sleeve 68 is secured to an inner tube or middle tube 14 at the first end 30. The sleeve 68 has an outer diameter equal to the outer diameter of the outermost tube 12. When the outer tube 12 closes on inner tube 14, the first end of the outer most tube 12 butts against the end of the sleeve 68. When the improved telescopic stabilizer 10 is in a closed position, it appears to be a single tube of a single diameter, resembling several other stabilizers on the market, with a line at the junction of sleeve 68 and the first end 30 of the outermost tube 12.

Figure 6:
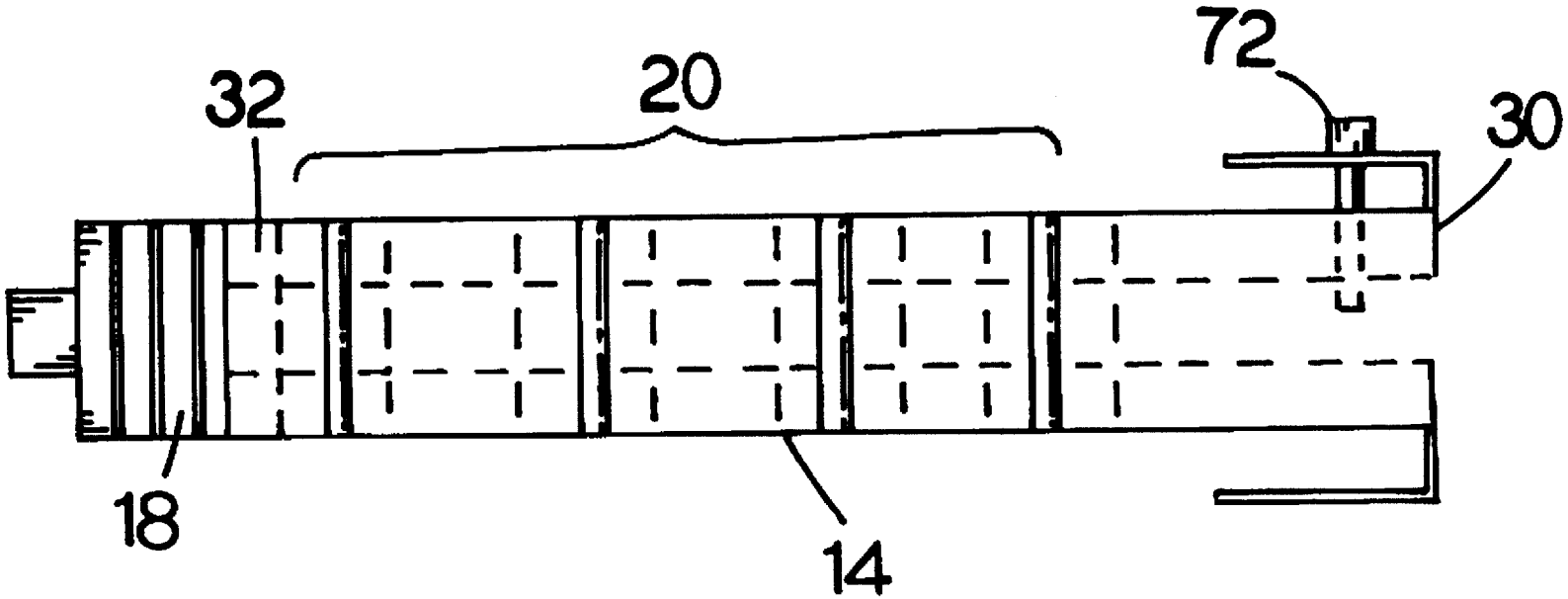
FIG. 6 is a side sectional view of an inner tube with a locking member having three O-rings, centering device consisting of three O-rings and a docking device with a bolt to lock an inner most tube in place.

The docking device 22 may also have a threaded bore laterally through one side. FIG. 6. The docking device 22 resembles a collar 70 attached to the first end 30 of an inner tube 14, typically the middle tube 14. A bolt 72 is screwed through the threaded bore to secure and lock the solid rod 54 in any position when used as the inner most tube 16 within the middle tube 14. The threaded bore and bolt 72 would only be used with a smooth type solid rod, as shown in FIG. 7. The sleeve also has an inside diameter at one end to receive the first end of the outer most tube 12. This secures and holds the ends together and provides an aesthetical pleasing and finished appearance.

The outer tubes may also have vent holes 74 through the outer tube along it's length to allow air input and escape as the inner tube slides within the outer tube.

Figure 18:
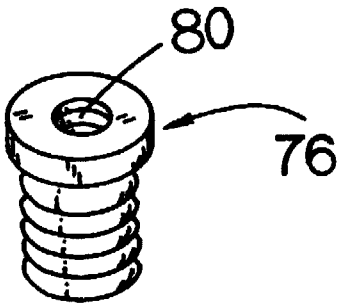
FIG. 18 is a view of another adapter having a threaded center bore.
Figure 19:
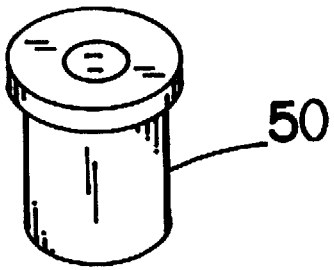
FIG. 19 is a typical attachment means having a centered threaded bore.
Figure 17:
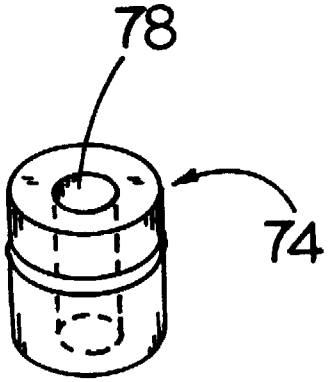
FIG. 17 is a view of an adapter having a smooth center bore.

Provisions are also include to convert a two tube improves telescopic stabilizer 10 to a three tube improved stabilizer 10. To do so two adapters 74 and 76 are provided shown in FIGS. 17 and 18. The adapters 74 and 76 fit within the first end 30 of the middle tube 14. These are typically pressed into the end and may be glued to prevent loosening. The adapters can be readily removed by heating the the first end 30 of the tube 14. The expansion of the tube 14 due to the heat allows the adapter 74 or 76 to be removed.

Adapter 74 contains a smooth centerd bore 78. The smooth centered bore 78 recieves an inner most tube 16 or solid rod 54. The adapter 76 has a centered threaded bore 80. This adapter functions and is similar to the attachment means 50. The threaded bore receives a threaded rod 48 for attachment of the improved telescopic stabilizer to an archer bow. The threaded bore 78, and the threaded bore on the attachment means 50 are threaded 5/16 24. This size is standard in the field of archery for attachment of stabilizers and other archer equipment.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. An improved telescopic stabilizer comprising:

a plurality of elongated tubes, said tubes slidably installed one over the other, each of said tubes having a first end, a second end, an inner surface having an inner diameter and an outer surface having an outer diameter, said tubes arranged with inner tube or tubes and outer tube or tubes, one of said inner tubes being an inner most tube, and one of said outer tubes being an outer most tube;

centering means between said inner tube or tubes and said outer tube or tubes to maintain center alignment of said inner tubes within said outer tubes when said tubes are locked in a telescopic position;

attachment means on said first end of said inner most tube and on said second end of said outer most tube, said attachment means having a center bore for attachment of said improved telescopic stabilizer to an archery bow and for attachment of weights, additional stabilizer, or a bow prop device to said improved telescopic stabilizer;

a plug located at said second end on said inner tube, said plug having an eccentrically located threaded bore on a lateral face;

an improved cylindrical locking member eccentrically and rotably attached to said plug, said locking member locking said inner tube within said outer tube when said tubes are rotated about one another; and an internal interlock comprising an enlarged off center bore through said locking member and a bolt extending through said enlarged off center bore to attach said locking member to said eccentrically located threaded bore on said plug, said internal interlock locking said locking member onto said bolt when said inner and outer tubes are rotated about each other.

2. The improved telescopic stabilizer as set forth in claim 1 in which said centering means comprises a very close tolerance between said inner diameter of an outer tube and said outer diameter of an inner tube, said tolerances reduce vibration and assist in maintaining center alignment of said inner tubes within said outer tube.

3. The improved telescopic stabilizer as set forth in claim 1 in which said centering means comprises a plurality of O-rings on said outer surface of said inner tubes snugly fitting in the space between said inner surface of said outer tube and said outer surface of said inner tube, said O-rings reduce vibrations and maintain center alignment of said inner tubes within said outer tube.

4. The improved telescopic stabilizer as set forth in claim 1 in which said centering means comprises a plurality of O-ring grooves along said outer surface of said inner tubes and O-rings installed within said O-ring grooves to close space between said inner surface of an outer tube and said outer surface of an inner tube to reduce vibration and to assist in maintaining center alignment of said inner tubes within said outer tube.

5. The improved telescopic stabilizer as set forth in claim 1 in which said inner tube comprises a plurality of tube sections joined together with couplers and said centering means comprises O-ring grooves and O-rings on an outer surface of said coupler.

6. The improved telescopic stabilizer as set forth in claim 1 in which said outer tube contains vent holes through said outer tube along it's length to allow air input and escape as said inner tube slides within said outer tube.

7. The improved telescopic stabilizer as set forth in claim 1 further comprising a docking device, said docking device attached to said first end of an inner tube, said docking device receiving and securing said first end of said outer tube when said improved telescopic stabilizer is in a collapsed position.

8. The improved telescopic stabilizer as set forth in claim 1 further comprising a solid rod and a locking collar, said solid rod slidable within said inner most tube through a smooth bore on said attachment means, said solid rod having a longitudinal threaded bore centered on a first end, said locking collar attached to a first end of said inner most tube, a bolt extending through a threaded bore on said collar and through a bore on said inner most tube locks said solid rod in position.

9. The improved telescopic stabilizer as set forth in claim 8 in which said collar further includes a docking device to receive and secure said first end of said outer most tube.

10. The improved telescopic stabilizer as set forth in claim 1 in which said plurality of tubes comprises an outer most tube, a center tube and an inner most tube.

11. The improved telescopic stabilizer as set forth in claim 1 in which said plurality of tubes comprises an outer most tube and an inner most tube.

12. The improved telescopic stabilizer as set forth in claim 1 in which said locking member further comprises a plurality of O-ring grooves and a plurality of O-rings in each of said grooves, said O-rings securely gripping and locking said inner tube within said outer tube when said tubes are rotated about one another.

13. The improved telescopic stabilizer as set forth in claim 1 in which said locking member is constructed from a nylon material that grips said inner surface of said inner tube.

14. An improved telescopic stabilizer comprising:

a plurality of elongated tubes, said tubes slidably installed one over the other, each of said tubes having a first end, a second end, an inner surface having an inner diameter and an outer surface having an outer diameter, said tubes arranged with inner tube or tubes and outer tube or tubes, one of said inner tubes being an inner most tube, and one of said outer tubes being an outer most tube;

centering means between said inner tube or tubes and said outer tube or tubes, said centering means consisting of O-rings placed within space between said outer surface of said inner tube or tubes and said inner surface of said outer tube or tubes, said centering means maintaining center alignment of said inner tubes within said outer tube when said tubes are locked in a telescopic position;

attachment means on said first end of said inner most tube and on said second end of said outer most tube, said attachment means having a center bore for attachment of said improved telescopic stabilizer to an archery bow and for attachment of weights, additional stabilizer, or a bow prop device to said improved telescopic stabilizer;

a plug located at said second end on each of said inner tubes;

an improved cylindrical locking member eccentrically and rotably attached to said plug by a bolt extending through an off center bore through said locking member, said bolt screwed and tightened into an eccentrically located threaded bore on said plug, said off center bore being substantially larger than the diameter of said bolt, said substantially larger bore and bolt providing an interlock to lock said locking member to said bolt, said locking member locking said inner tube within said outer tube when said tubes are rotated about one another; and a docking device, said docking device attached to said first end of said inner tube, said docking device receiving and securing a first end of said outer tube when said improved telescopic stabilizer is in a collapsed position, said docking device providing an aesthetical pleasing and finished appearance.

15. The improved telescopic stabilizer as set forth in claim 14 further including O-ring grooves along the outer surface of said inner tubes, said O-ring grooves receiving said O-rings to hold said O-rings in a fixed position.

16. The improved telescopic stabilizer as set forth in claim 14 in which said locking member comprises a plurality of O-ring grooves and a plurality of O-rings, said O-rings gripping said inner surface of said outer tubes to securely hold said inner tube within said outer tube when said tubes are rotated about each other.

17. The improved telescopic stabilizer as set forth in claim 14 in which said docking device comprises a collar having a first inner diameter to securely attach said collar to said outer surface on said first end of inner tube and a second inner diameter for receiving and holding said first end of said outer tube when said improved telescopic stabilizer is in a collapsed position.

18. The improved telescopic stabilizer as set forth in claim 14 in which said first end of said outer and inner tubes are tapered.

19. An improved telescopic stabilizer having telescoping tubes, the improvements comprising:

a plurality of telescoping tubes;

a centering means between an outer surface of an inner tube and an inner surface of an outer tube, said centering means maintaining center position of said inner tube within said outer tube when said tubes are in a locked telescopic position;

a locking member, said locking member eccentrically and rotatably attached to an end of said inner tube that is inserted into said outer tubes, said locking member gripping said inside surface of said outer tube when said tubes are twisted about one another;

an internal interlock comprising an off center bore through said locking member and a bolt for attachment to said end of said inner tube, said off center bore having a diameter greater than the outer diameter of said bolt, said internal interlock locking said looking member to said bolt; and a docking device, said docking device comprising a collar attached to an outer end of an inner tube, said outer tubes abutting against said docking device when said improved telescopic stabilizer is in a closed position providing an aesthetic appearance and securing said end of said outer tube.

20. The improved telescopic stabilizer as set forth in claim 19 in which said centering means comprises an O-ring between said inner tube and said outer tube, said O-rings centering said inner tube within said outer tube when said tubes are in a locked position, said O-rings preventing vibrations and noise caused by tube vibrations.

21. The improved telescopic stabilizer as set forth in claim 19 in which said locking member comprises a cylindrical member with three O-ring grooves and three O-rings, said O-rings installed onto said cylindrical member in said O-ring grooves, said O-rings gripping said inner surface of said outer tube when said tubes are rotated about one another.

22. The improved telescopic stabilizer as set forth in claim 19 in which said locking member comprises an cylindrical nylon rod, said nylon rod gripping said inside surface of said outer tube when said tubes are rotated about one another.

* * * * *